US005297295A

United States Patent [19]

Barbeau et al.

[11] Patent Number: 5,297,295

[45] Date of Patent: Mar. 29, 1994

[54] FIRE PROTECTIVE COAT WITH CLOSURE FLAP HAVING INTEGRAL FLAP THROAT PROTECTIVE BAND WITH OPPOSED ADJUSTABLE WINGS

[75] Inventors: Claude Barbeau, St. Lambert; Ross Cochran, Montreal, both of Canada

[73] Assignee: Securitex Inc., Montreal, Canada

[21] Appl. No.: 31,113

[22] Filed: Mar. 12, 1993

[51] Int. Cl.[5] ..... A41D 1/00

[52] U.S. Cl. ..... 2/96; 2/141.1; 2/81; 2/85; 2/93

[58] Field of Search ..... 2/96, 93, 94, 98, 85, 2/69, 81, 82, 129, 133, 134, 135, 139, 140, 141 A, 141 R, DIG. 6, 108

[56] References Cited

U.S. PATENT DOCUMENTS

| | | | |
|---|---|---|---|
| 870,004 | 11/1907 | Winks | 2/98 |
| 3,833,938 | 9/1974 | Shweid | 2/96 |
| 5,115,516 | 5/1992 | Golde | 2/98 |
| 5,127,106 | 7/1992 | Aldridge | 2/96 |
| 5,153,941 | 10/1992 | Grilliot et al. | 2/98 |

FOREIGN PATENT DOCUMENTS

| | | | |
|---|---|---|---|
| 1224 | of 1893 | United Kingdom | 2/98 |

OTHER PUBLICATIONS

Gershman, M.D., Maurice, "Self-Adhering Nylon Tapes" Journal of the American Medical Association, vol. 68, No. 7, p. 930.

*Primary Examiner*—Andrew M. Falik
*Assistant Examiner*—Gloria Hale

[57] ABSTRACT

A fire protective coat formed of fire protective material and having a closeable frontal opening. A closure flap is secured adjacent the frontal opening and is securable thereover. A collar is formed about a neck opening of the coat. A throat protective band is formed integrally in a top section of the closure flap to provide a continuous shield of the opening between opposed free end portions of the collar. The protective band extends above the flap and has opposed wing sections extending from opposed sides of the flap. Each flap is independently and variably attachable to a respective one of the opposed free end portions of the collar to independently adjust the size and configuration of the neck opening depending on the desired size of the neck opening.

7 Claims, 2 Drawing Sheets

FIRE PROTECTIVE COAT WITH CLOSURE FLAP HAVING INTEGRAL FLAP THROAT PROTECTIVE BAND WITH OPPOSED ADJUSTABLE WINGS

BACKGROUND OF INVENTION

1. Field of the Invention

The present invention relates to a fire protective coat, and particularly to a firefighter's coat, and wherein a throat protective band is formed integrally in a top end of a closure flap and has wing sections extending from opposed sides of the flap and independently adjustable with opposed free end portions of a collar provided about a neck opening of the coat.

2. Description of Prior Art

It is known to provide throat protective chin straps for fire protective garments, such as, for example, described in U.S. Pat. Nos. 5,153,941 and 5,167,037. Such protective bands have adjustable features on one side thereof whereby to accommodate accessories, such as a breathing apparatus, for firefighters. While the mask is positioned over the firefighter's face, the chin strap should offer protection to the throat area of the wearer. However, this is often not properly provided. A firefighter's coat is also intended to protect the wearer against water as well as intense heat and flames. The chin straps disclosed in the above referenced patents do not completely seal the throat opening between the terminal ends of the collar and accordingly, water, heat and flame can infiltrate inside the coat from under the chin strap. Also, the chin strap is laterally adjustable with respect to one side only thereof. This means that the collar, when expanded to accommodate a breathing apparatus or other accessories, will only provide expansion from one side of the collar and this will distort the throat opening, thereby not providing maximum protection and often making it uncomfortable to the wearer.

A still further disadvantage of some throat protecting chin straps is that they are not permanently secured to the coat and are easily lost, therefore not offering the wearer any throat protection if the coat is worn without the chin strap.

SUMMARY OF INVENTION

It is a feature of the present invention to provide a fire protective coat having a throat protective band which is provided with opposed wing sections which are independently adjustable with opposed free end portions of a collar.

Another feature of the present invention is to provide a fire protective coat having a throat protective band which is integrally formed in a top section of a closure flap of the coat and is provided with opposed wing sections extending from both sides of the flap and wherein the wing sections each have variable attachment means.

Yet another distinctive feature is that it effectively prevents the ingress of water and fire products from below the throat tab.

According to the above features, from a broad aspect, the present invention provides a fire protective coat formed of fire protective material and having a frontal opening with closure means for securing the frontal opening in a closed position. A closure flap is secured adjacent the frontal opening and has detachable connectable means for securement over the opening when the opening is closed. The coat has a collar about a neck opening thereof. The collar has opposed free end portions on a respective side of a top end of the opening. A throat protective band of fire protective material is formed integrally in a top portion of the closure flap to provide a continuous shield of the top end of the opening. The protective band has a central section extending above the flap and aligned with the opening when closed, and opposed wing sections extending from opposed sides of the central section. Variable attachment means interconnects each of the wing sections to an associated one of the opposed free end portions of the collar so that the protective band and the collar encircles a wearer's neck. The attachment means independently adjusts the size and configuration of the neck opening from either side of the top end of the opening.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
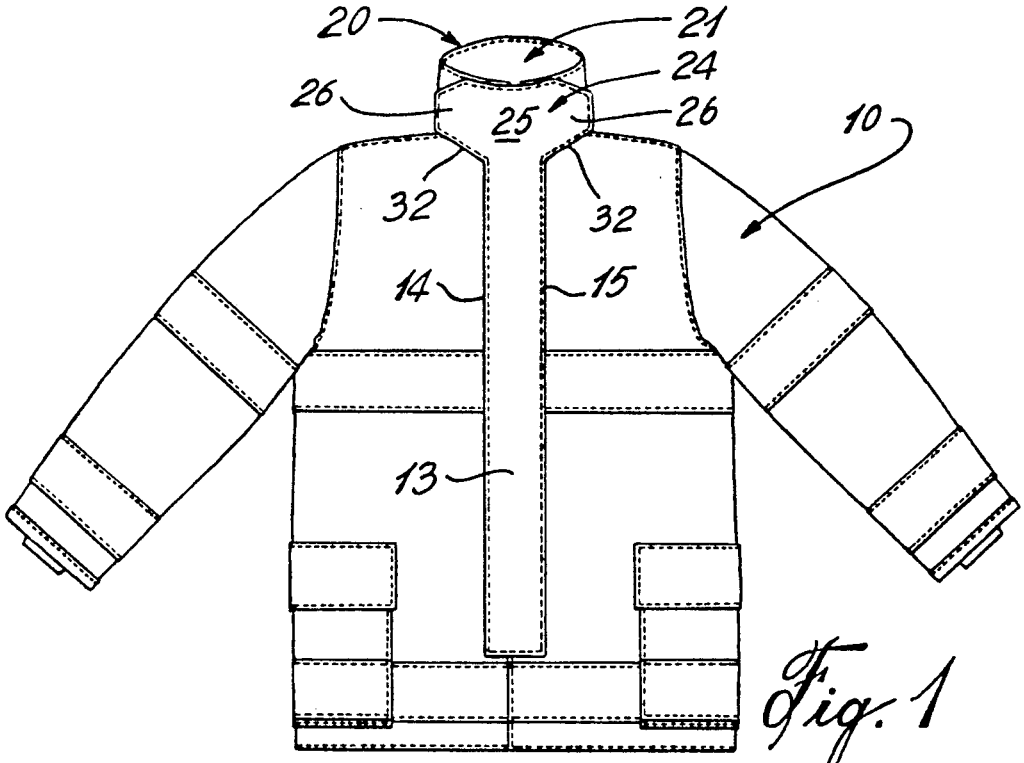
FIG. 1 is a frontal view of a firefighter's coat incorporating the throat protective band of the present invention.
Figure 2:
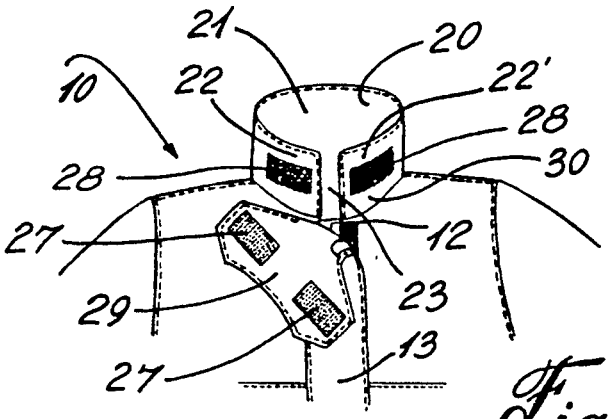
FIG. 2 is a fragmented top frontal view of the coat of FIG. 1 showing the throat protective band detached from the collar.
Figure 3:
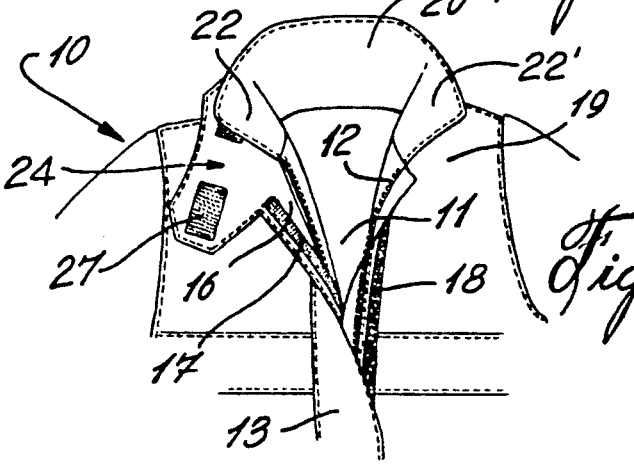
FIG. 3 is a view similar to FIG. 2 but showing the top portion of a frontal opening in a disengaged position together with a top portion of the closure flap detached.

Referring now to the drawings, and more particularly to FIGS. 1 to 3, there is shown generally at 10, a fire protective coat, such as a firefighter's coat, which is formed of fire protective material. The coat has a frontal opening 11, as shown in FIG. 3, with a closure means, herein a zipper 12, permitting the wearer entry into the coat and for securing the frontal opening in a closed position, as shown in FIG. 1.

As herein shown, an elongated rectangular storm closure flap 13 is secured adjacent the frontal opening 11 by a stitch line 14 extending from top to bottom of the flap and in substantially spaced parallel relationship with the zipper 12. The inside face 16 of the flap 13 is provided with connectable means in the form of an elongated strip 17 of hook and pile attachment means, commonly identified by the Trade Mark Velcro, for mating attachment with a component part strip 18 secured to the coat front wall 19 but on the other side of the frontal opening 11.

A collar 20 is formed about a neck opening 21 of the jacket. The collar herein shown is of substantially constant width and has opposed free end portions 22 and 22' positioned on the respective side of the frontal opening 11 and forms an opening 23 between the collar ends.

A throat protective band 24 also formed of fire protective material, is formed integral in a top section of the closure flap 13 and defines a central section 25 and opposed wing sections 26 which extend from opposed sides of the central section in the storm flap 13. Variable attachment means in the form of hook and pile complementary component parts 27 and 28 interconnect each of the wing sections 26 to an associated one of the opposed free end portions 22 and 22' of the collar so that the protective band 24 and the collar encircles a wearer's neck. The hook and pile attachment components 27 and 28 provide for independent adjustment of the size and configuration of the neck opening 21 from either side of the top opening 23.

Figure 5:
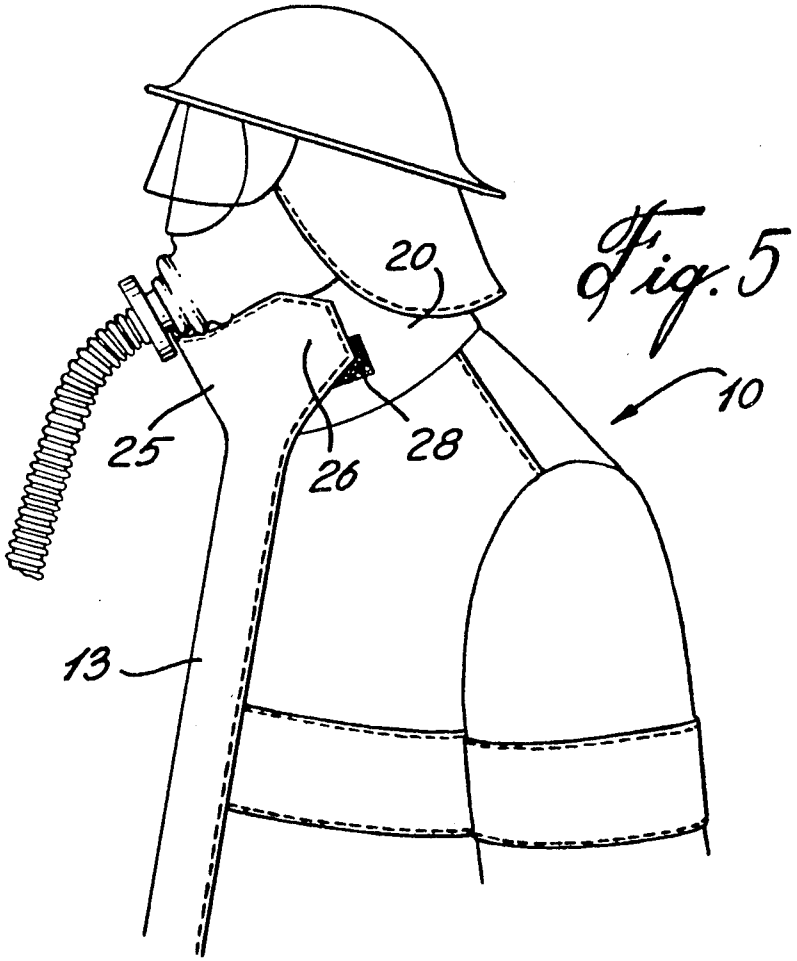
FIG. 5 is a view similar to FIG. 4 but showing the wings of the throat protective band in a different engaged position to enlarge the throat opening of the jacket to accommodate a larger neck or a breathing apparatus of a firefighter.
Figure 4:
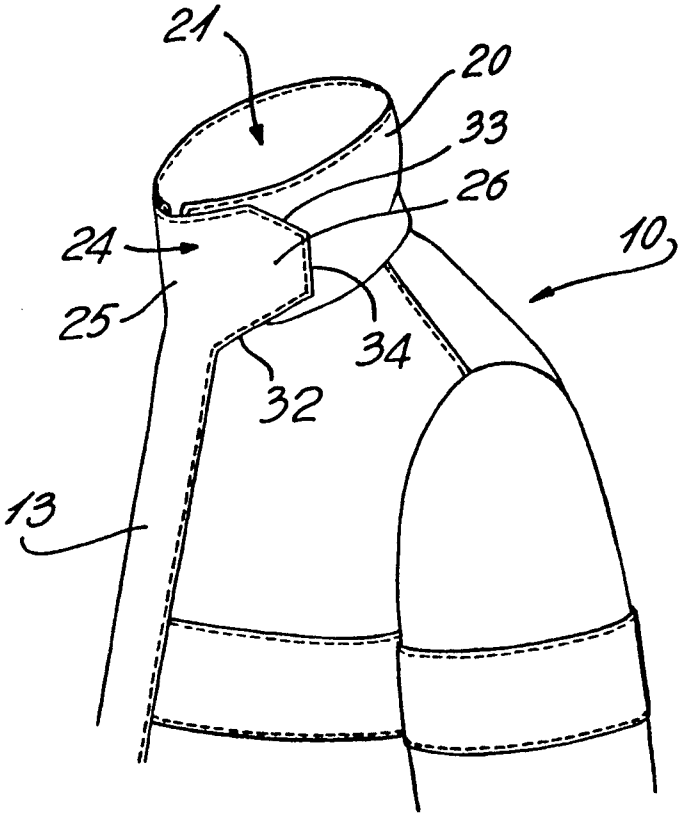
FIG. 4 is a side view of the top portion of FIG. 1 showing the throat protective band in an engaged position.

Referring now additionally to FIGS. 4 and 5, it can be seen that the wing sections 26 have a specific configuration and are at least as wide as collar 20. The attachment components 27 and 28 are elongated rectangular components secured in a substantially horizontal position to a respective one of the back face 29 of the throat protective band 24 and the front faces 30 of the opposed free end portions 22 and 22' of the collar. Accordingly, these elongated components can provide adjustment from both sides of the opening 23 and in an equilibrated manner so as to provide a comfortable fit about the wearer's neck or about a breathing apparatus fitted to a wearer's face, as shown in phantom lines 31 in FIG. 5. Because the closure flap is adjustable from both sides, it permits symmetrical adjustment to better accomodate a variety of breathing apparatus masks worn by firefighters and further provides longer adjustment length and angle, as shown in FIG. 5.

As more clearly shown in FIGS. 4 and 5, each of the wing sections 26 are trapezoidal sections and have an upwardly angled lower edge 32 and downwardly angled top end edge section 33 with a straight transverse end edge 34. The bottom and top bevelled edges 32 and 33 provide for a more comfortable fit when the throat protective band is hinged out, as shown in FIG. 5, so that there are no sharp corners to obstruct the wearer's neck or face. Of course, the end portions of the wing sections may also be rounded or have other suitable shape.

The throat protective band is formed as a T-shaped top extension of the storm flap 13, and therefore is always attached to the coat and cannot be lost. Also, the fact that the flap and the throat protective band are formed as a single piece, it provide continuous protection along the throat portion of the jacket in front of the collar, thus shielding the opening 23 between the opposed free end portions of the collar and protecting the wearer against heat flame and water entering this opening, particularly so when a breathing apparatus.

We claim:

1. A firefighter's protective coat formed of fire protective material, said coat having a frontal opening with closure means for securing said frontal opening in a closed position, a closure flap secured adjacent said frontal opening and having detachable connectable means entirely therealong for securement over said opening when said opening is closed, said coat having a collar about a neck opening thereof, said collar having opposed free end portions on a respective side of a central neck opening, and a throat protective band of fire protective material formed integrally in a top section of said closure flap to provide a continuous shield of said central neck opening; said protective band having a central section extending above said flap and aligned with said central neck opening when closed, and opposed wing sections extending from opposed side edges of said closure flap to form an integral T-shaped top end section, said wing sections at said side edges of said closure flap being at least as wide as said collar and having a predetermined length to permit expansion of said neck opening of said collar while maintaining shielding of said central neck opening; variable attachment means interconnecting each said wing sections to an associated one of said opposed free end portions of said collar to provide for said expansion of said collar so that said protective band and said collar encircles a firefighter's neck of different size even when wearing a breathing apparatus, said attachment means independently adjusting the size and configuration of said neck opening from either side of said top end of said opening.

2. A firefighter's protective coat as claimed in claim 1 wherein said variable attachment means is a hook and pile attachment means having complementary component parts secured to a back face of each said wing sections and a front face of said opposed free end portions of said collar to each side of said top end of said opening.

3. A firefighter's protective coat as claimed in claim 2 wherein said component parts of said hook and pile attachment means are elongated rectangular components secured in a substantially horizontal position to respective ones of said back and front faces from adjacent end edges of said wing sections and opposed free end portions of said collar.

4. a firefighter's protective coat as claimed in claim 2 wherein said closure flap detachable connectable means is a hook and pile connectable means having an elongated component part secured along a free edge of a back face of said flap and adjacent said closure means away from said openings.

5. A firefighter's protective coat as claimed in claim 4 wherein said flap is stitched to said coat along an elongated edge from the bottom to a top part adjacent one of said wing sections and substantially in spaced parallel relationship to said closure means.

6. A firefighter's protective coat as claimed in claim 5 wherein said closure means is a zipper fastener.

7. A firefighter's protective coat as claimed in claim 2 wherein each said wing sections are generally trapezoidal sections having an upwardly angled lower edge and downwardly angled top end edge section to provide unobstruction to a wearer's face and to facilitate hinging of the protective band.

* * * * *